US008361300B2

(12) United States Patent
Kuzmanovic et al.

(10) Patent No.: US 8,361,300 B2
(45) Date of Patent: Jan. 29, 2013

(54) METHOD TO ELECTRODEPOSIT METALS USING IONIC LIQUIDS

(75) Inventors: Boris Kuzmanovic, De Bilt (NL); Cornelis Johannes Govardus Van Strien, Elst (NL); Colin Eric Bartel, Apeldoorn (NL); Michael Zeitler, Alfter (DE); Johanna Christina Speelman, Warnsveld (NL)

(73) Assignee: Akzo Nobel N.V., Arnhem (NL)

( * ) Notice: Subject to any disclaimer, the term of this patent is extended or adjusted under 35 U.S.C. 154(b) by 987 days.

(21) Appl. No.: 12/279,517

(22) PCT Filed: Feb. 12, 2007

(86) PCT No.: PCT/EP2007/051329

§ 371 (c)(1),
(2), (4) Date: Sep. 29, 2008

(87) PCT Pub. No.: WO2007/093574

PCT Pub. Date: Aug. 23, 2007

(65) Prior Publication Data

US 2009/0236227 A1 Sep. 24, 2009

Related U.S. Application Data

(60) Provisional application No. 60/778,971, filed on Mar. 6, 2006.

(30) Foreign Application Priority Data

Feb. 15, 2006 (EP) ..... 06101714

(51) Int. Cl.
*C25D 3/00* (2006.01)

(52) U.S. Cl. ..... 205/234

(58) Field of Classification Search ..... 205/234
See application file for complete search history.

(56) References Cited

U.S. PATENT DOCUMENTS

| | | | | |
|---|---|---|---|---|
| 4,849,438 | A | 7/1989 | Iriuchijima et al. | |
| 6,552,843 | B1 | 4/2003 | Tench et al. | |
| 7,196,221 | B2 | 3/2007 | Abbott et al. | |
| 2004/0054231 | A1* | 3/2004 | Abbott et al. | 564/282 |
| 2004/0061919 | A1 | 4/2004 | Tench et al. | |
| 2004/0097755 | A1* | 5/2004 | Abbott et al. | 562/553 |
| 2004/0150866 | A1 | 8/2004 | Tench et al. | |

FOREIGN PATENT DOCUMENTS

| | | | |
|---|---|---|---|
| EP | 0404188 | A1 | 12/1990 |
| EP | 1322591 | B1 | 3/2005 |
| JP | 04193976 | | 7/1992 |
| JP | 2002371397 | | 12/2002 |
| WO | WO 02/26381 | | 4/2002 |
| WO | WO 02/26701 | | 4/2002 |
| WO | WO 2006/074523 | A1 | 7/2006 |
| WO | WO 2007/093574 | A2 | 8/2007 |

OTHER PUBLICATIONS

"Sweet Success: Ionic Liquids Derived from Non-Nutritive Sweeteners" by Carter et al., Chem. Commun. 6, pp. 630-631 (2004).*
Gordon et al., "Fused Organic Salts. 8. Properties of Molten Straight-Chain Isomers of Tetra-*n*-pentylammonium Salts," *Journal of the American Chemical Society*, vol. 100, No. 24, pp. 7445-7454, (1978).
Sun et al., "Room-Temperature Molten Salts Based on the Quaternary Ammonium Ion," *J. Phys. Chem. B*, vol. 102, No. 44, pp. 8858-8864, (1998).
Sakaebe et al., "Discharge-Charge Properties of Li/$LiCoO_2$ Cell Using Room Temperature Ionic Liquids (RTILs) Based on Quaternary Ammonium Cation-Effect of the Structure," *Journal of Power Sources* 146, pp. 693-697, (2005).
Matsumoto et al., "Preparation of Room Temperature Ionic Liquids Based on Aliphatic Onium Cations and Asymmetric Amide Anions and Their Electrochemical Properties as a Lithium Battery Electrolyte," *Journal of Power Sources* 146, pp. 45-50, (2005).
Chen et al., "Electrodeposition of Cesium at Mercury Electrodes in the Tri-1-Butylmethylammonium Bis((trifluoromethyl)sulfonyl)imide Room-Temperature Ionic Liquid," *Electrochimica Acta* 49, pp. 5125-5138 (2004).
Murase et al., "Electrochemical Behaviour of Copper in Trimethyl-*n*-hexylammonium Bis((trifluoromethyl)sulfonyl)imide, an Ammonium Imide-Type Room Temperature Molten Salt," *Journal of Applied Electrochemistry*, vol. 31, pp. 1089-1094, (2001).

(Continued)

*Primary Examiner* — Jonathan Johnson
*Assistant Examiner* — Bryan D. Ripa
(74) *Attorney, Agent, or Firm* — Norris McLaughlin & Marcus PA

(57) ABSTRACT

The present invention relates to a method to electroplate or electropolish a metal on a substrate wherein an ionic liquid is selected from the group of $N^+R_1R_2R_3R_4\ X^-$ or $N^+R_5R_6R_7R_8\ Y^-$ is employed as electrolyte, and a metal salt added to the ionic liquid is employed as the metal source or a metal anode is used as the metal source, wherein any one of $R_1$ to $R_8$ independently represents a hydrogen, alkyl, cycloalkyl, aryl, or aralkyl group that may be substituted with a group selected from OH, Cl, Br, F, I, phenyl, $NH_2$, CN, $NO_2$, $COOR_9$, CHO, $COR_9$, or $OR_9$, at least one of $R_5$ to $R_8$ is a fatty alkyl chain, and one or more of $R_5$ to $R_8$ can be a (poly)oxyalkylene group wherein the alkylene is a $C_1$ to $C_4$ alkylene and the total number of oxyalkylene units can be from 1 to 50 oxyalkylene units, and at least one of $R_1$ to $R_8$ is a $C_1$ to $C_4$ alkyl chain, $R_9$ is an alkyl or cycloalkyl group, X− is an anion having an N-acyl sulphonylimide anion (—CO—N⁻—$SO_2$—) functionality, $Y^-$ is an anion compatible with the $N^+R_5R_6R_7R_8$ ammonium cation, such as a halogenide anion, a carboxylate anion, a sulphate (both organic and inorganic sulphate), sulphonate, carbonate, nitrate, nitrite, thiocyanate, hydroxide, or sulphonylimide anion.

20 Claims, 3 Drawing Sheets

OTHER PUBLICATIONS

Figure 1A:
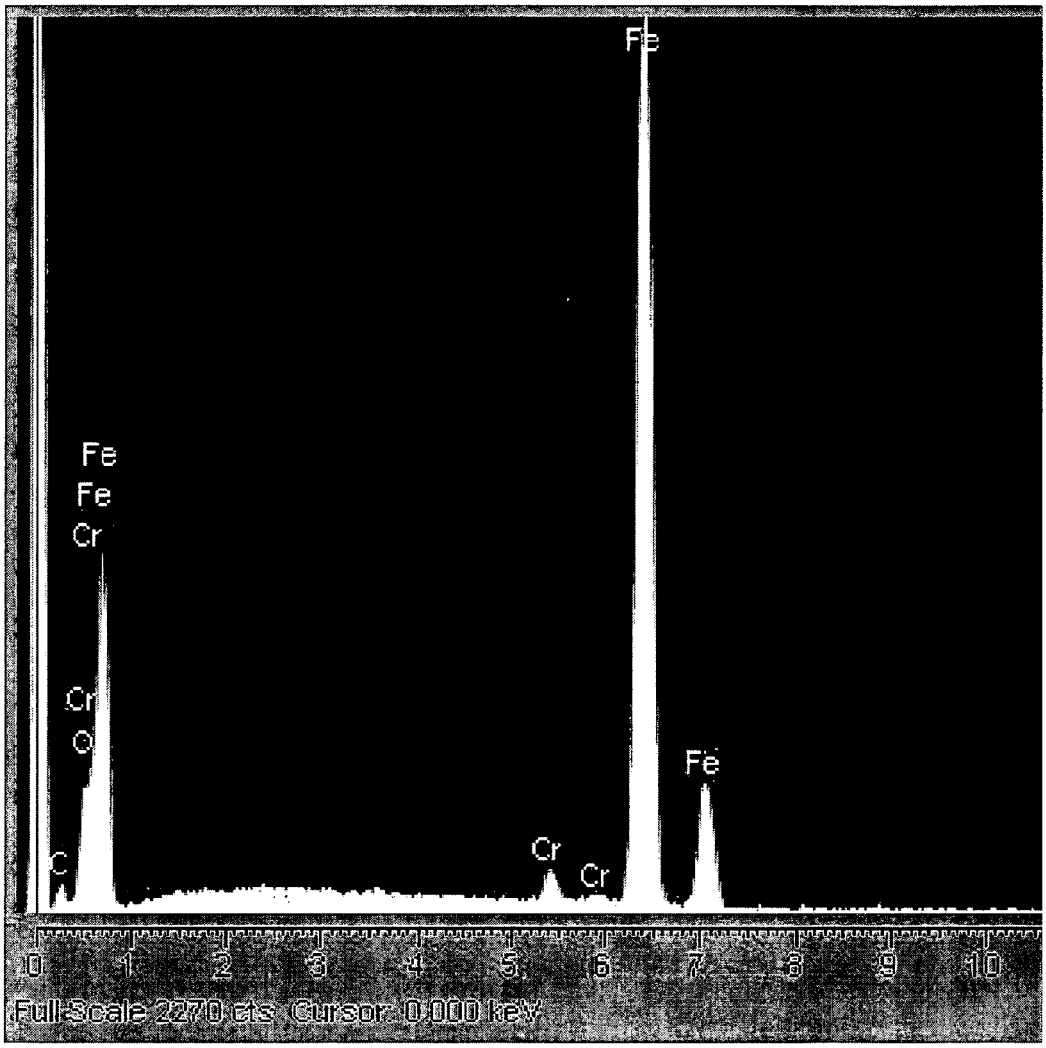

T. Beyersdorff et al., "Ionic Liquids Today," *Ionic Liquids Today*, Issue 3/05, pp. (2005).

Carter et al., "Sweet success: Ionic Liquids Derived From Non-Nutritive Sweeteners," *The Royal Society of Chemistry*, pp. 630-631, (2004).

Matsumoto et al., "Electrodeposition of Sodium and Lithium in Room Temperature Ionic Liquid: N-Methyl-N-Butylpyrrolidinium Trifluoromethyltrifluoroborate," *Journal of Rare Earths*, vol. 23, pp. 26-29, (2005).

Matsumoto et al., "Highly Conductive Room Temperature Molten Salts Based on Small Trimethyalkylammonium Cations and Bis(trifluoromethylsulfonyl)imide," *The Chemical Society of Japan*, pp. 922-923, (2000).

Matsumoto et al., "Room Temperature Ionic Liquids Based on Small Aliphatic Ammonium Cations and Asymmetric Amide Anions," *The Royal Society of Chemistry*, pp. 1726-1727, (2000).

Zhou et al., "Low-Melting, Low-Viscous, IIydrophobic Ionic Liquids: Aliphatic Quaternary Ammonium Salts with Perfluoroalkyltrifluoroborates," *Chem. Eur. .J.*, vol. 11, pp. 752-766, (2005).

McFarlane et al., "High Conductivity Molten Salts Based on the Imide Ion," *Electrochimica Acta 45*, pp. 1271-1278, (2000).

Tang et al., "Low-Pressure $CO_2$Sorption I Ammonium-Based Poly(ionic Liquid)s," *Polymer* 46, pp. 12460-12467, (2005).

*IUPAC Compendium of Chemical Terminology*, (1997), XP-002448766.

International Search Report, International Application No. PCT/EP2007/051329, mailed Sep. 18, 2007.

International Preliminary Report on Patentability and Written Opinion, International Application No. PCT/EP2007/051329, mailed Jun. 18, 2008.

International Search Report for International Application No. PCT/EP2008/059962, Nov. 4, 2008.

European Search Report for European Application No. 07113717.8, Jan. 9, 2008.

XP-001172435; Wang et al., "Gelation of Ionic Liquid-Based Electrolytes with Silica Nanoparticles for Quaasi-Solid-State . . . ," vol. 125, No. 5, pp. 1166-1167 (2003).

http://www.merck-chemicals.com/ionic-liquids/c__g1ib.s1Lhu4AAAEWqOEfVhTI, Aug. 26, 2010.

http://www.iolitec.de/index__e.htm, Aug. 26, 2010.

"Electrically Mediated Process for Functional Trivalent Chromium to Replace Hexavalent Chromium: Scale-up for Manufacturing Insertion", by R.P. Renz, et al.; Plating & Surface Finishing, Jun. 2003, pp. 52-59.

* cited by examiner

METHOD TO ELECTRODEPOSIT METALS USING IONIC LIQUIDS

REFERENCE TO RELATED APPLICATION(S)

This application is the U.S. National Phase of PCT/EP2007/051329 filed on Feb. 12, 2007 and claims the benefit of U.S. Provisional Application No. 60/778,971 filed on Mar. 6, 2006.

The present invention relates to a method to electrodeposit a metal on a substrate using an ionic liquid as the electrolyte.

Ionic liquids are non-volatile salts with a melting point below 100° C. Many are liquid even at room temperature and they represent a relatively new class of solvents.

It is known that, in general, ionic liquids may be used in many applications, e.g. as reaction solvents, extraction solvents, electrolytes in batteries and electrodeposition, catalysts, heat exchange fluids, as additives in coatings.

Until now, all commercially available ionic liquids suitable for use as electrolytes in electrodeposition have been relatively high-priced, i.e. in the order of about 50 Euros up to about 1,000 Euros per kilogram. The term electrodeposition in this application should be understood to include both electroplating and electropolishing.

A number of examples of the use of ionic liquids are disclosed for example on Merck's and lolitec's web pages: www.ionicliquids-merck.de and www.iolitec.com (dated Feb. 3, 2006).

Ionic liquids said to be useful in electrodeposition methods are specifically trioctylmethylammonium trifluoromethane sulphonate, N-methyl,N-trioctylammonium bis(trifluoromethylsulphonyl)imide, trimethyl-N-hexylammonium bis(trifluoromethylsulphonyl)imide, N-butyl, N-trimethylammonium bis(trifluoromethylsulphonyl)imide, 1-butyl-1-methylpyrrolidinium bis(trifluoromethylsulphonyl)imide, 1-hexyl-3-methylimidazolium tris(pentafluoroethyl) trifluorophosphate, 1-butyl-3-methylimidazolium trifluoroacetate, which are all quite expensive and carry the risk of very dangerous HF being formed as a decomposition product of fluorine-containing ionic liquids.

The price of eutectic mixtures such as choline chloride/chromium chloride hexahydrate or choline chloride/zinc chloride, also reported to be used in electrodeposition, likewise is rather high. Furthermore, consumption of the metal salt which is a building component of such ionic liquids during the electrodeposition process may lead to decomposition of such ionic liquids.

WO 2002/026381 discloses ionic liquids (eutectic mixtures) of choline chloride and a (hydrated) metal salt such as chromium(III) chloride and the use thereof in electrodeposition and electropolishing. The mixtures consist of choline chloride and the (hydrated) metal salt in a ratio of ammonium to metal ion of between 1:1 and 1:2.5 and are specifically said to be suitable for depositing chromium, cobalt, zinc or silver on a metal substrate.

However, there is a desire for ionic liquids suitable for use in an electrodeposition process which give a good quality of electrodeposited metal on a substrate (i.e. an electrocoated substrate with a good appearance or with adequate hardness) while at the same time they are economically attractive, or in other words, available in high quality at a low price. Also, there is a need in the industry for electrolytes suitable for use in an electrodeposition process which are energy efficient, not based on the use of toxic chemicals, and which enable large-scale plating. Moreover, there is a need for a method to deposit metals on a substrate that requires only a low metal concentration in the solvent, as this gives an improvement from an economic point of view and makes the process more controllable.

Also, there is a desire for a method of electrodepositing metals on a substrate in which ionic liquid is used as an electrolyte wherein the ionic liquid has good electrical conductivity, a satisfying electrochemical stability range, and can dissolve sufficient quantities of the salts of the metal to be satisfactorily deposited on the substrate.

Finally, there is a desire for a more suitable way of depositing certain metals using an electrochemical method, such materials currently being deposited using the methods known in the art, which pose significant health and environmental risks. Aluminium and titanium are examples of metals that cannot be deposited from aqueous solutions and are deposited from non-aqueous organic electrolytes. As such organic baths present an explosion and fire hazard, electrodeposition of such metals in more acceptable solvents would be highly beneficial. Furthermore, the present industrial chromium deposition processes still are based on chromic acid, which contains highly carcinogenic chromium (VI) (see e.g. *Modern Electroplating* by F. A. Lowenheim, 1942 or *Electroplating Engineering Handbook* by L. J. Durney, 1996). Also, conventional chromium plating baths require the use of strong acids, which poses significant disposal problems, while the use of the compounds of the invention enables such disposal difficulties to be minimised or eliminated.

The present invention now provides a method to electroplate or electropolish a metal on a substrate wherein an ionic liquid selected from the group of $N^+R_1R_2R_3R_4\ X^-$ and $N^+R_5R_6R_7R_8\ Y^-$ is employed as electrolyte and a metal salt added to the ionic liquid is employed as the metal source or a metal anode is used as the metal source, wherein any one of $R_1$ to $R_8$ independently represents a hydrogen, alkyl, cycloalkyl, aryl, or aralkyl group that may be substituted with a group selected from OH, Cl, Br, F, I, phenyl, $NH_2$, CN, $NO_2$, $COOR_9$, CHO, $COR_9$, or $OR_9$, at least one of $R_5$ to $R_8$ is a fatty alkyl chain, and one or more of $R_5$ to $R_8$ can be a (poly)oxyalkylene group wherein the alkylene is a $C_1$ to $C_4$ alkylene and the total number of oxyalkylene units can be from 1 to 50 oxyalkylene units, and at least one of $R_1$ to $R_8$ is a $C_1$ to $C_4$ alkyl chain, $R_9$ is an alkyl or cycloalkyl group, $X^-$ is an anion having an N-acyl sulphonylimide anion (—CO—$N^-$—$SO_2$—) functionality, $Y^-$ is an anion compatible with the $N^+R_5R_6R_7R_8$ ammonium cation, such as a halogenide anion, a carboxylate anion, a sulphate (both organic and inorganic sulphate), sulphonate, carbonate, nitrate, nitrite, thiocyanate, hydroxide, or sulphonylimide anion; preferably it is $Cl^-$, $Br^-$ or $CH_3SO_4^-$.

In one embodiment, $Y^-$ is selected from the group of $F^-$, $Cl^-$, $Br^-$, $I^-$; the group of $R_{10}COO^-$ anions wherein $R_{10}$ may be hydrogen, a $C_1$-$C_{22}$ alkyl, alkenyl or aromatic group; the group of $R_{11}SO_4^-$ anions wherein $R_{11}$ may be absent, in which case the cation is divalent, hydrogen, a $C_1$-$C_{22}$ alkyl, alkenyl or aromatic group; the group of $R_{12}SO_3^-$ anions wherein $R_{12}$ may be absent, in which case the cation is divalent, hydrogen, a $C_1$-$C_{22}$ alkyl, alkenyl or aromatic group; the group of $R_{13}CO_3^-$ anions wherein $R_{13}$ may be absent, in which case the cation is divalent, hydrogen, a $C_1$-$C_{22}$ alkyl, alkenyl or aromatic group; and the group of $R_{14}$—$N^-$—$SO_2$—$R_{15}$ anions wherein $R_{14}$ and/or $R_{15}$ independently may be hydrogen, a $C_1$-$C_{22}$ alkyl, alkenyl or aromatic group, and $R_{14}$ may be linked to the nitrogen atom with a carbonyl group.

A fatty alkyl chain is meant to include saturated and/or unsaturated chains and contains 8 to 22 carbon atoms; preferably, it contains 10 to 22 carbon atoms, most preferably 12 to 20 carbon atoms.

In one embodiment, the $N^+R_5R_6R_7R_8$ $Y^-$ ionic liquid has an iodine value of above 1, preferably above 2, more preferably above 3, and most preferably above 5 g $I_2$ per 100 gr of ionic liquid. The iodine value generally is below 210 g $I_2$ per 100 gr of ionic liquid.

In a preferred embodiment, $X^-$ is based on a compound known as a sweetener. In another preferred embodiment, $N^+R_1R_2R_3R_4$ is an amine wherein the groups $R_1$ to $R_4$ are hydrogen or an alkyl or cycloalkyl, optionally substituted with OH or Cl; more preferably, at least three thereof are an alkyl, more preferably a $C_1$ to $C_4$ alkyl.

In a preferred embodiment, the ionic liquid is selected from any one of choline saccharinate, choline acesulphamate, hexadecyltrimethyl ammonium chloride, octadecyltrimethyl ammonium chloride, cocotrimethyl ammonium chloride, tallowtrimethyl ammonium chloride, hydrogenated tallowtrimethyl ammonium chloride, hydrogenated palmtrimethyl ammonium chloride, oleyltrimethyl ammonium chloride, soyatrimethyl ammonium chloride, cocobenzyldimethyl ammonium chloride, C12-16-alkylbenzyldimethyl ammonium chloride, hydrogenated tallowbenzyldimethyl ammonium chloride, dioctyldimethyl ammonium chloride, didecyldimethyl ammonium chloride, dicocodimethyl ammonium nitrite, dicocodimethyl ammonium chloride, di(hydrogenated tallow)dimethyl ammonium chloride, di(hydrogenated tallow)benzylmethyl ammonium chloride, ditallowedimethyl ammonium chloride, dioctadecyldimethyl ammonium chloride, hydrogenated tallow(2-ethylhexyl) dimethyl ammonium chloride, hydrogenated tallow(2-ethylhexyl)dimethyl ammonium methylsulphate, trihexadecylmethyl ammonium chloride, octadecylmethylbis(2-hydroxyethyl) ammonium chloride, cocobis(2-hydroxyethyl)methyl ammonium nitrate, cocobis(2-hydroxyethyl)methyl ammonium chloride, cocobis(2-hydroxyethyl)-benzyl ammonium chloride, oleylbis(2-hydroxyethyl)methyl ammonium chloride, coco [polyoxyethylene(15)]methyl ammonium chloride, coco [polyoxyethylene(15)]methyl ammonium methylsulphate, coco[polyoxyethylene(17)]methyl ammonium chloride, octadecyl[polyoxyethylene(15)]methyl ammonium chloride, hydrogenated tallow[polyoxyethylene(15)]methyl ammonium chloride, tris(2-hydroxyethyl)tallow ammonium acetate, tallow-1,3-propane pentamethyl diammonium dichloride.

U.S. Pat. No. 4,849,438 discloses choline saccharinate, a method to prepare choline saccharinate, and the use of choline saccharinate to protect plants against fungi and bacteria. The choline saccharinate reaction product of Preparation Example 1 first is an oily substance and later is in the crystal form because of the presence of 0.3 mol $H_2O$ per mol of choline saccharinate. In Preparation Example 3 choline saccharinate is prepared by reacting choline chloride and sodium saccharinate. It is not acknowledged that choline saccharinate is an ionic liquid, but in Example 3 it is implicitly understood to be an ionic liquid.

E. B. Carter et al. in *Chemical Communications* 2004, (6), 630-631 disclose ionic liquids of saccharinate and acesulphamate anions and a quaternary ammonium cation such as a triethylmethyl ammonium or an imidazolium cation.

J. Tang et al in *Polymer* 46 (2005), pp. 12460-12467 disclose a dodecyltriethyl ammonium based ionic liquid and the $CO_2$ sorption thereof.

However, none of the above documents discloses or suggests the suitability of N-acyl sulphonyl imide based or fatty alkyl based ionic liquids for use in a method to electrodeposit metals on a substrate.

The above-indicated ionic liquids formed are safe—potentially food grade—and can be applied as a solvent in an electrodeposition or electropolishing method, since they contain a relatively low concentration of metal salt. On the other hand, the metal salt concentration range is broad, or in other words, the method to electrodeposit metals on a substrate according to the invention is controllable over a wide range of a relatively low metal salt concentration. The plated substrate resulting from the process according to the present invention has an improved appearance compared to the methods of the state of the art using other ionic liquids as the electrolyte. What is more, when using some of the ionic liquids disclosed in the state of the art as electrolyte in a method to electrodeposit, we were unable to get a layer of metal deposited on the substrate at all, especially not when the metal was used in the preferred amount as specified in this description.

The above-indicated ionic liquids for use in the method according to the invention can be prepared by a simple reaction of salts, for example by a metathesis reaction of choline chloride and sodium saccharinate (acesulphamate) to form a choline saccharinate (acesulphamate) ionic liquid.

Also, it has been found that an ionic liquid made on the basis of commercially available compounds, such as hydrogenated tallow methyl[polyoxyethylene(15)]ammonium chloride, cocoalkylmethyl[polyoxyethylene(15)]ammonium chloride, cocoalkylmethyl[polyoxyethylene(15)]ammonium methylsulphate, octadecylmethyl[polyoxyethylene(15)]ammonium chloride, and di(hydrogenated tallow) dimethyl ammonium chloride used as surfactants and rheology modifiers, is suitable to be employed in the process according to the invention.

In a preferred embodiment, the molar ratio of the ammonium cation of the ionic liquid to the metal cation of the metal salt, which comes from the dissolved salt or from the metal anode, is between 1,000:1 and 3:1. More preferred is a molar ratio of the ammonium cation of the ionic liquid to the metal cation of the metal salt of between 500:1 and 5:1, most preferred is a molar ratio between 100:1 and 7:1, this providing a high-quality metal layer, excellent dissolution of the metal in the ionic liquid, and a good balance between the cost of the process and the appearance of the plated substrate product.

In another preferred method to electrodeposit according to the present invention, one of the metals chromium, aluminium, titanium, zinc or copper is deposited; more preferably, chromium or aluminium is deposited, most preferably chromium.

The electrodeposition is preferably performed at temperatures below 90° C. and more preferably at room temperature, in open electrodeposition vessels, but electrodeposition is not limited to these conditions. In the embodiment where a metal anode is used, the anode may be in the form of metal pieces, chunks, chips or any other suitable form known to the skilled person.

The ionic compounds according to the invention also find application in electropolishing. For example, stainless steel can be polished using compounds according to the invention. Stainless steels form the largest commercial application for electropolishing and traditionally polishing baths contain mixtures based on concentrated sulphuric and phosphoric acids. These are highly toxic and corrosive and prone to form toxic and corrosive "mists" during electropolishing as a result of prodigious gas evolution due to the high current densities used. A major advantage of the preferred electropolishing processes according to the invention is that they are generally more environmentally friendly compared with the conventional methods. Additional advantages offered are that they can be performed at room temperature and can operate with lower power consumption, whilst providing bright reflective finishes comparable to traditional techniques. An additional advantage of the materials in accordance with the invention is that when they are used in electrolytic baths, in particular plating or electropolishing baths, hydrogen evolution is significantly reduced as compared with the acidic baths conventionally employed. This has a number of important consequences. First, it results in a very high current efficiency. Current efficiencies as high as 90% or more can be obtained in favourable circumstances. Reduced hydrogen evolution is also advantageous from the safety standpoint and significantly reduces the amount of hydrogen embitterment that occurs in the substrate material during the electrochemical process. It also results in plated materials having an improved surface finish, with greatly diminished micro-cracking compared to electroplating produced by conventional methods. This in turn can improve the corrosion resistance of the coatings and/or allow the use of coatings which are thinner yet provide comparable corrosion resistance to that of conventional coatings, which thus are cheaper to produce, less consumptive of raw materials, and more environmentally friendly.

DETAILED DESCRIPTION OF THE DRAWNGS

FIG. 1*a* is a scanning electron micrograph with X-ray dispersion (SEM/EDX) showing the presence of chromium at the submerged portion of the substrate in Example 2.

Figure 1B:
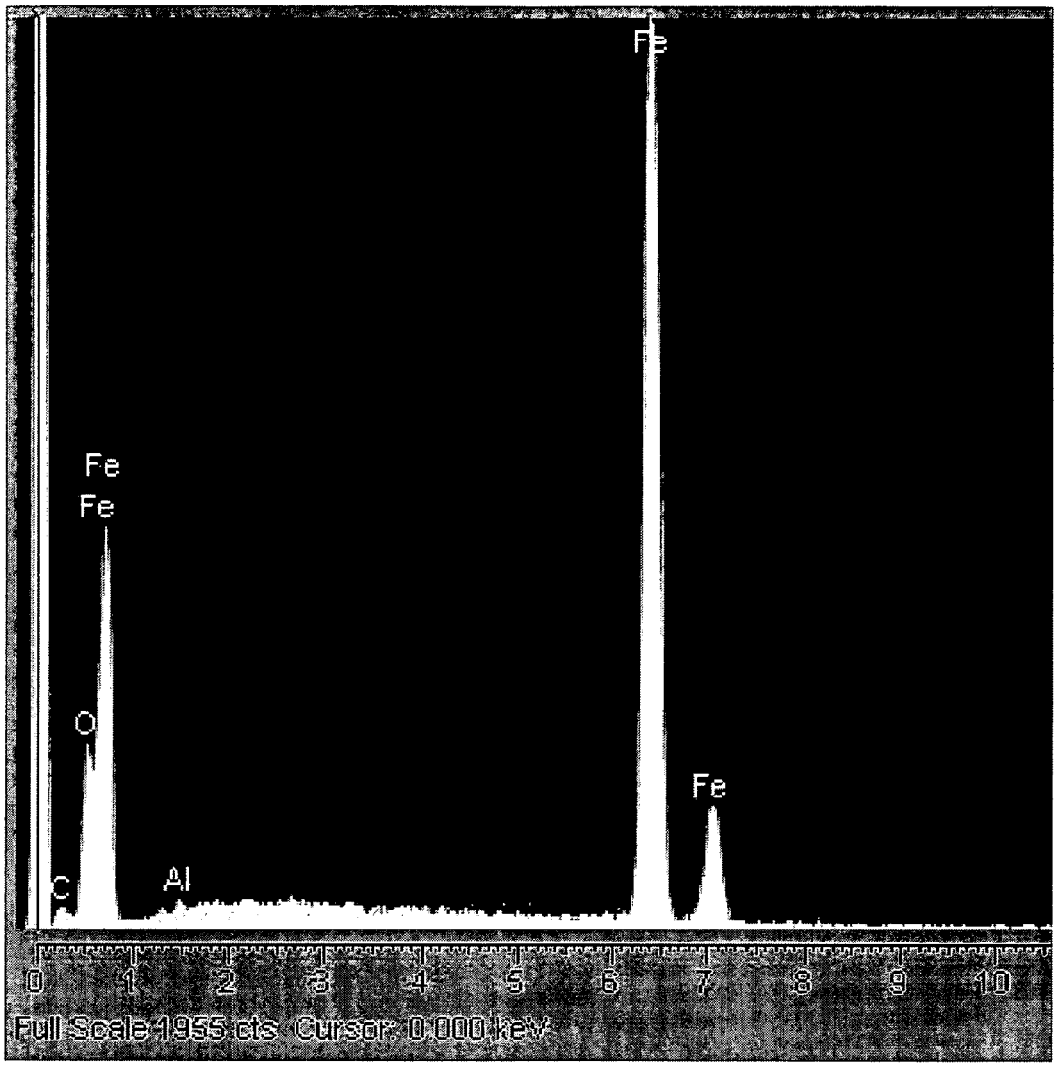

FIG. 1*b* is a scanning electron micro graph with X-ray dispersion (SEM/EDX) showing the absence of chromium at the submerged portion of the substrate in Example 2.

Figure 2:
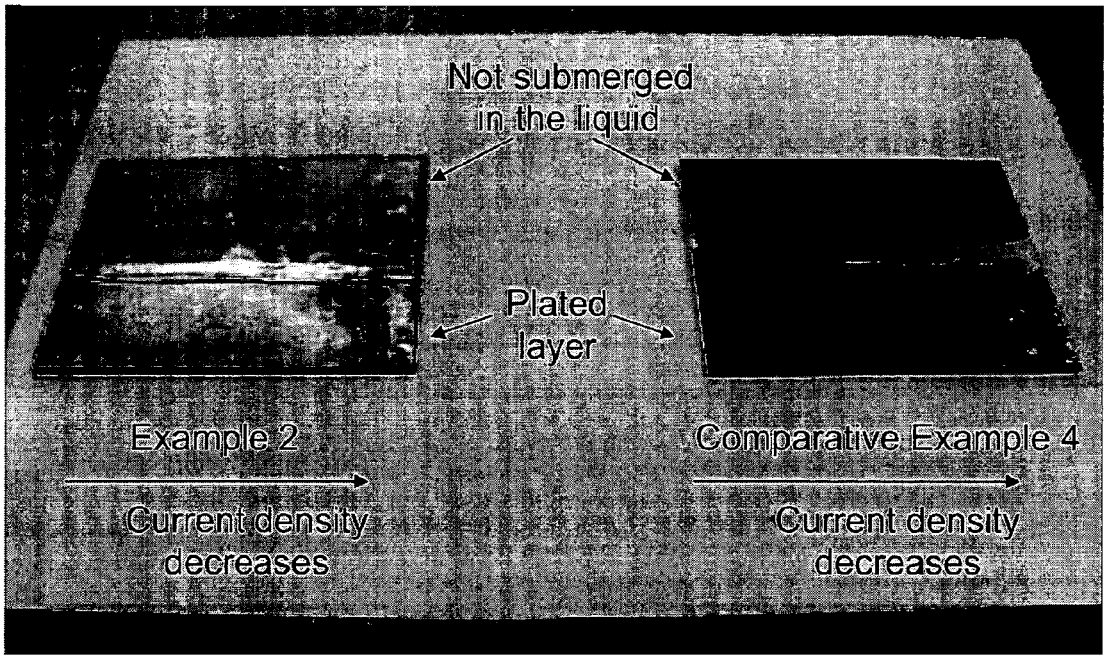

FIG. 2 shows a comparison between substrates treated with the method of Example 2 and a method of Comparative Example 4, demonstrating that the method according to the present invention, Example 2, results in a shiny metallic substrate while the comparative method results in dark mat deposits on the substrate.

EXAMPLES

Preparation Example A

Preparation of Semi-Dry Choline Saccharinate Ionic Liquid 1,080 g of sodium saccharinate hydrate (99%, ex Acros) were mixed with 732 g of solid choline chloride (99%, ex Acros), using 6 l of acetone as solvent. After 8 hours of agitating, allowing for ion exchange reaction to take place, the formed suspension was filtered. The filtrate was subjected to evaporation in a Rotavap at a temperature of about 60° C. and minimal pressure of about 40 mbar until no further evaporation of the solvent was observed. The remaining product was a liquid and was confirmed to be choline saccharinate by elemental chemical composition analysis (chloride, sodium, and sulphur concentration).

Preparation Example B

Preparation of Dry Choline Saccharinate Ionic Liquid

Sodium saccharinate hydrate (99%, ex Acros) was dried at a temperature of 120° C. until no further decrease in mass was observed, in order to remove any water present. After that the dry sodium saccharinate was mixed with choline chloride (99%, ex Acros), in 1:1 molar ratio, using acetone as solvent. After 8 hours of agitating, allowing for ion exchange reaction to take place, the formed suspension was filtered. The filtrate was subjected to evaporation in a Rotavap at a temperature of about 85° C. and minimal pressure of about 40 mbar until no further evaporation of the solvent was observed. The remaining product was a liquid and was confirmed to be dry choline saccharinate by elemental chemical composition analysis (chloride, sodium, and sulphur concentration, and also water concentration).

Example 1

Electroplating of Copper onto Brass in a Semi-Dry Choline Saccharinate

Into prepared choline saccharinate ionic liquid that contained around 2 wt % of water, copper (II) chloride dihydrate salt was charged and the mixture was stirred until the solid salt dissolved. In the prepared solution the concentration of copper was around 11 g/kg, whereas the molar ratio of the amine salt to the copper-hydrated salt was 21:1.

Around 250 ml of the solution was poured into a Hull cell equipped with an electrical heating element which had a length of 65 mm on the anode side and 102 mm on the cathode side, a 48 mm shortest anode-cathode distance, a 127 mm longest anode-cathode distance, and a depth of 65 mm. The cell was heated to a temperature between 70 and 80° C. The liquid was agitated using a centrally positioned top-entering impeller.

Platinised titanium plate was applied as the anode and connected to the positive terminal of a DC power source, whereas brass plate was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The current flow was monitored on a meter connected in series.

After 1.5 hours of electroplating, the cathode was disconnected from the power source and taken out of the cell. The plate was washed in water and acetone and then dried. On the portion of the plate submerged in the ionic liquid during electroplating, an orangy/brown copper-deposited layer was observed. The thickness of the layer decreased from one side of the plate to the other due to the differences in current density at different positions of the cathode.

Example 2

Electroplating of Chromium from Cr (III) Salt onto Carbon Steel in a wet Choline Saccharinate Into a prepared choline saccharinate ionic liquid that contained around 7 wt % of water chromium (III) chloride hexahydrate salt was charged and the mixture was stirred until the solid salt dissolved. To increase the ratio of the amine salt to the chromium salt and at the same time improve the solubility of chromium salt, choline chloride was added. In the prepared solution the concentration of chromium (III) was around 20 g/kg, whereas the molar ratio of the amine salt to the chromium hydrated salt was 9:1.

Around 250 ml of the solution was poured into the Hull cell described in Example 1. The cell was heated to a temperature between 70 and 80° C. The liquid was agitated using a centrally positioned top-entering impeller.

Platinised titanium plate was applied as the anode and connected to the positive terminal of a DC power source, whereas carbon steel was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The current flow was monitored on a meter connected in series.

After 5 hours of electroplating, the cathode was disconnected from the power source and taken out of the cell. The plate was washed in water and acetone and then dried. On the portion of the plate submerged in the ionic liquid during the electroplating, a light grey (metallic colour) deposited layer was observed. The thickness of the layer decreased from one side of the plate to the other due to the differences in current density at different positions of the cathode, having no visible layer at one side. The chemical composition of the plate was analysed by scanning electron microscopy combined with X-ray dispersion (SEM/EDX).

The analysis confirmed the presence of chromium at the submerged portion of the substrate (FIG. 1*a*), whereas no chromium was found at the non-submerged surface (FIG. 1*b*).

Example 3

Electroplating of Chromium from Cr (III) Salt onto Carbon Steel in a semi-dry Choline Saccharinate Into a prepared choline saccharinate ionic liquid that contained around 2 wt % of water chromium (III) chloride hexahydrate salt was charged and the mixture was stirred until the solid salt dissolved. In the prepared solution the concentration of chromium (III) was around 12 g/kg, whereas the molar ratio of the amine salt to the chromium hydrated salt was 13:1.

Around 250 ml of the solution was poured into the Hull cell described in Example 1. The cell was heated to a temperature between 70 and 80° C. The liquid was agitated using a centrally positioned top-entering impeller.

Platinised titanium plate was applied as the anode and connected to the positive terminal of a DC power source, whereas carbon steel was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The current flow was monitored on a meter connected in series.

After 5 hours of electroplating, the cathode was disconnected from the power source and taken out of the cell. The plate was washed in water and acetone and then dried. The chemical analysis by scanning electron microscopy combined with X-ray dispersion (SEM/EDX) indicated the presence of a very thin deposited layer.

Comparative Example 4

Electroplating of Chromium from Cr (III) Salt onto carbon Steel in a 2:1 Molar Ratio Eutectic Mixture of chromium (III) chloride hexahydrate and choline chloride Chromium (III) chloride hexahydrate and choline chloride were mixed in a 2:1 molar ratio. The solid mixture was heated for several hours in an oven at a temperature of around 120° C. The mixture was shaken from time to time, until no more solids were observed. The dark green liquid product was cooled down to room temperature.

Example 2 was repeated, but using the produced eutectic mixture of 2:1 molar ratio of chromium (III) chloride hexahydrate and choline chloride instead of the solution used in Example 2.

In FIG. 2 the appearance of the substrates of Example 2 and Comparative Example 4 is illustrated. It is clearly demonstrated that the method in accordance with the present invention results in an improved visual appearance of the plated substrate (shiny metallic instead of dark mat deposit).

Example 5

Electroplating of Chromium from $CrCl_3$ Hexahydrate Salt onto Carbon Steel in cocoalkylmethyl[polyoxyethylene(15)]ammonium chloride Chromium (III) chloride hexahydrate salt was added to cocoalkylmethyl[polyoxyethylene(15)]ammonium chloride ionic liquid containing 0.2 wt % of water and the mixture was agitated at a temperature of around 50° C. until the solid salt dissolved. In the prepared solution the concentration of chromium (III) chloride hexahydrate was 75 g/kg.

Around 250 ml of that solution was poured into the Hull cell described in Example 1. The cell was heated to a temperature between 70 and 80° C.

Platinised titanium plate was applied as the anode and connected to the positive terminal of a DC power source, whereas carbon steel was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The liquid was agitated using a centrally positioned top-entering impeller. The current flow between the electrodes was monitored on a meter connected in series.

After 18 hours of electroplating, the cathode was disconnected from the power source and taken out of the cell. The plate was washed in water and acetone and then dried. Chemical analysis by scanning electron microscopy combined with X-ray dispersion (SEM/EDX) of the substrate was performed. Both the submerged and the non-submerged part of the plate were analysed. On the non-submerged part only iron, carbon, and oxygen were found, whereas the submerged part contained chromium, iron, carbon, and oxygen, confirming the deposition of the chromium onto the substrate. In addition to that, a coverage of the submerged part of the plate by a metallic layer could be observed visually.

Example 6

Electroplating of Chromium Using $CrCl_2$ as a Source of Chromium onto Carbon Steel in cocoalkylmethyl[polyoxyethylene(15)]ammonium chloride Dry chromium (II) chloride was added to cocoalkylmethyl [polyoxyethylene(15)]ammonium chloride ionic liquid containing 0.2 wt % of water and the mixture was agitated at a temperature of around 50° C. until the solid salt could be considered dissolved. In the prepared solution the concentration of chromium (II) chloride was 30 g/kg.

Around 250 ml of that solution was poured into the Hull cell described in Example 1. The cell was heated to a temperature between 70 and 80° C.

Platinised titanium plate was applied as the anode and connected to the positive terminal of a DC power source, whereas carbon steel was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The liquid was agitated using a centrally positioned top-entering impeller. The current flow between the electrodes was monitored on a meter connected in series.

After 18 hours of electroplating, the cathode was disconnected from the power source and taken out of the cell. The plate was washed in water and acetone and then dried. On the portion of the plate submerged in the ionic liquid during the electroplating, a light bluish-grey metallic deposited layer was observed to cover more than 95% of the area. Chemical analysis by scanning electron microscopy combined with X-ray dispersion (SEM/EDX) of the substrate was performed. Both the submerged and the non-submerged part of the plate were analysed. On the non-submerged part iron, carbon, and oxygen were found, whereas the submerged part contained chromium, iron, and carbon, confirming the deposition of the chromium onto the substrate Example 7

Electroplating of Chromium Using $CrCl_3$ Hexahydrate as a Source of Chromium onto Carbon Steel in Wet cocoalkylmethyl[polyoxyethylene(15)]ammonium methylsulphate Chromium (III) chloride hexahydrate was charged to cocoalkylmethyl[polyoxyethylene(15)]ammonium methylsulphate ionic liquid into which 10 wt % of water was introduced prior to the addition of chromium salt. The mixture was agitated at a temperature of around 50° C. until the solid salt dissolved. In the prepared solution the concentration of chromium (III) chloride hexahydrate was 74 g/kg.

Around 250 ml of that solution was poured into the Hull cell described in Example 1. The cell was heated to a temperature between 70 and 80° C.

Platinised titanium plate was applied as the anode and connected to the positive terminal of a DC power source, whereas carbon steel was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The liquid was agitated using a centrally positioned top-entering impeller. The current flow between the electrodes was monitored on a meter connected in series.

After 5 hours of electroplating, the cathode was disconnected from the power source and taken out of the cell. The plate was washed in water and acetone and then dried. Chemical analysis by scanning electron microscopy combined with X-ray dispersion (SEM/EDX) of the substrate was performed. Both the submerged and the non-submerged part of the plate were analysed. On the non-submerged part iron, carbon, and oxygen were found, whereas the submerged part contained chromium, iron, carbon, and oxygen, confirming the deposition of the chromium onto the substrate.

Example 8

Electroplating of Chromium Using Chromium (III) Acetylacetonate as a Source of Chromium onto Carbon Steel in cocoalkylmethyl[polyoxyethylene(15)]ammonium chloride Chromium (III) acetylacetonate (97%, ex Acros) was added to cocoalkylmethyl[polyoxyethylene(15)]ammonium chloride ionic liquid containing 0.2 wt % of water and the mixture was agitated at a temperature of around 50° C. until the solid salt could be considered dissolved. In the prepared solution the concentration of chromium (III) acetylacetonate was 10 g/kg.

Around 250 ml of that solution was poured into the Hull cell described in Example 1. The cell was heated to a temperature between 70 and 80° C.

Platinised titanium plate was applied as the anode and connected to the positive terminal of a DC power source, whereas carbon steel was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The liquid was agitated using a centrally positioned top-entering impeller. The current flow between the electrodes was monitored on a meter connected in series.

After 5 hours of electroplating, the cathode was disconnected from the power source and taken out of the cell. The plate was washed in water and acetone and then dried. Chemical analysis by scanning electron microscopy combined with X-ray dispersion (SEM/EDX) of the substrate was performed. Both the submerged and the non-submerged part of the plate were analysed. On the non-submerged part iron, carbon, and oxygen were found, whereas the submerged part contained chromium, iron, carbon, and oxygen, confirming the deposition of the chromium onto the substrate.

Example 9

Electroplating of Chromium Using Chromium Anode (Chromium Metal Chips) as a Source of Chromium onto Carbon Steel in cocoalkylmethyl[polyoxyethylene(15)]ammonium chloride Around 250 ml of cocoalkylmethyl[polyoxyethylene(15)] ammonium chloride ionic liquid containing 0.2 wt % of water was poured into the Hull cell described the Example 1. The cell was heated to a temperature between 70 and 80° C.

Chromium metal chips, 2 mm thick, were charged into a titanium basket. This basket was applied as the anode and connected to the positive terminal of a DC power source, whereas carbon steel was used as the cathode (substrate) and connected to the negative terminal. Prior to introduction into the bath, the substrate plate was cleaned with a commercial scouring powder, washed in demineralised water, in acetone and after that in ethanol, and finally in a 4 M-HCl aqueous solution. When both plates were connected and introduced into the cell, the voltage difference was set to 30 V. The liquid was agitated using a centrally positioned top-entering impeller. The current flow between the electrodes was monitored on a meter connected in series.

After 5 hours of electroplating, the cathode was disconnected from the power source and taken out of the cell. The plate was washed in water and acetone and then dried. Chemical analysis by scanning electron microscopy combined with X-ray dispersion (SEM/EDX) of the substrate was performed. Both the submerged and the non-submerged part of the plate were analysed. On the non-submerged part iron, carbon, and oxygen were found, whereas the submerged part contained chromium, iron, carbon, and oxygen, confirming the deposition of the chromium onto the substrate.

Comparative Example 10

Electroplating of Chromium from $CrCl_3$ Hexahydrate Salt onto Carbon Steel in N-methyl-N-trioctylammonium bis(trifluoromethylsulphonyl)imide Example 5 was repeated, but using N-methyl-N-trioctylammonium bis(trifluoromethylsulphonyl)imide ionic liquid (98%, ex Solvent Innovation) instead of cocoalkylmethyl [polyoxyethylene(15)]ammonium chloride ionic liquid as used in Example 5.

After 18 hours of electroplating, the cathode was disconnected from the power source and taken out of the cell. The plate was washed in water and acetone and then dried. Chemical analysis by scanning electron microscopy combined with X-ray dispersion (SEM/EDX) of the substrate was performed. Both the submerged and the non-submerged part of the plate were analysed. No chromium was found on any part of the plate. Hence, no detectable chromium deposition occurred. As under the same conditions and with the same chromium source applied (Example 5) a chromium deposit was formed when using cocoalkylmethyl[polyoxyethylene (15)]ammonium chloride ionic liquid, which is covered in the present patent, the advantage of the method in accordance with the present invention is clearly demonstrated.

Comparative Example 11

Of Chromium from $CrCl_2$ onto Carbon Steel in N-methyl-N-trioctylammonium bis(trifluoromethylsulphonyl)imide Example 6 was repeated, but using N-methyl-N-trioctylammonium bis(trifluoromethylsulphonyl)imide ionic liquid (98%, ex Solvent Innovation) instead of cocoalkylmethyl [polyoxyethylene(15)]ammonium chloride ionic liquid as used in Example 6.

After 5 hours of electroplating, the cathode was disconnected from the power source and taken out of the cell. The plate was washed in water and acetone and then dried. Chemical analysis by scanning electron microscopy combined with X-ray dispersion (SEM/EDX) of the substrate was performed. Both the submerged and the non-submerged part of the plate were analysed. No chromium was found on any part of the plate. Hence, no detectable chromium deposition occurred. As under the same conditions and with the same chromium source applied (Example 6) a chromium deposit was formed when using cocoalkylmethyl[polyoxyethylene (15)]ammonium chloride ionic liquid, which is covered in the present patent, the advantage of the method in accordance with the present invention is clearly demonstrated.

The invention claimed is:

1. A method to electrodeposit a metal on a substrate; wherein an ionic liquid of the formula $$N^+R_5R_6R_7R_8\,Y^-$$

is employed as an electrolyte, and the metal source is either a metal salt added to the ionic liquid or a metal anode; wherein any one of $R_5$ to $R_8$ independently represents a hydrogen alkyl, cycloalkyl, aryl, or aralkyl group that may be substituted with a member of the group consisting of OH, CI, Br, F, I, phenyl, $NH_2$, CN, $NO_2$, $COOR_9$, CHO, $COR_9$, and $OR_9$; at least one of $R_5$ to $R_8$ is a saturated or unsaturated alkyl chain having 8 to 22 carbon atoms, and one or more of $R_5$ to $R_8$ is an oxyalkylene group wherein the alkylene is a $C_1$ to $C_4$ alkylene and the total number of oxyalkylene units is from 1 to 50 oxyalkylene units, and at least one of $R_5$ to $R_8$ is a $C_1$ to $C_4$ alkyl chain; $R_9$ is an alkyl or cycloalkyl group; $Y^-$ is an anion compatible with the $N^+R_5R_6R_7R_8$ ammonium cation.

2. The method to electrodeposit according to claim 1 wherein $Y^-$ is selected from the group consisting of $F^-$; $CI^-$; $Br^-$; $I^-$; $SO_4^{2-}$; $SO_3^{2-}$; $CO_3^{2-}$; the group of $R_{10}COO^-$ anions wherein $R_{10}$ may be hydrogen, a $C_1$-$C_{22}$ alkyl, alkenyl or aromatic group; the group of $R_{11}SO_4$ anions wherein $R_{11}$ may be hydrogen, a $C_1$-$C_{22}$ alkyl, alkenyl or aromatic group; the group of $R_{12}SO_3^-$ anions wherein $R_{12}$ may be hydrogen, a $C_1$-$C_{22}$ alkyl, alkenyl or aromatic group; the group of $R_{13}CO_3^-$ anions wherein $R_{13}$ may be hydrogen, a $C_1$-$C_{22}$ alkyl, alkenyl or aromatic group; and the group of $R_{14}$—$N^-$—$SO_2$—$R_{15}$ anions wherein at least one of $R_{14}$ and $R_{15}$ is independently hydrogen, a $C_1$-$C_{22}$ alkyl, alkenyl or aromatic group, and $R_{14}$ may be linked to the nitrogen atom with a carbonyl group.

3. The method to electrodeposit according to claim 2 wherein $Y^-$ is $CI^-$, $Br^-$ or $CH_3SO_4^-$.

4. The method to electrodeposit according to claim 1 wherein the ionic liquid of the formula N+R5R6R7R8 Y− has an iodine value of above 1 g 12 per 100 g of ionic liquid.

5. The method to electrodeposit according to claim 1 wherein the molar ratio of the ammonium cation of the ionic liquid to the metal cation of the metal salt or derived from the metal anode is between 1,000:1 and 3:1.

6. The method to electrodeposit according to claim 5 wherein the molar ratio is between 100:1 and 7:1.

7. The method to electrodeposit according to claim 1 wherein the metal is selected from the group consisting of chromium, aluminium, and copper.

8. The method to electrodeposit according to claim 1 wherein the ionic liquid is selected from the group consisting of, octadecylmethylbis(2-hydroxyethyl) ammonium chloride, cocobis(2-hydroxyethyl)methyl ammonium nitrate, cocobis(2-hydroxyethyl)methyl ammonium chloride, cocobis(2-hydroxyethyl)benzyl ammonium chloride, oleylbis(2-hydroxyethyl)methyl ammonium chloride, coco[polyoxyethylene(15)]methyl ammonium chloride, coco [polyoxyethylene(15)]methyl ammonium methylsulphate, coco[polyoxyethylene(17)]methyl ammonium chloride, octadecyl[polyoxyethylene(15)]methyl ammonium chloride, hydrogenated tallow[polyoxyethylene(15)]methyl ammonium chloride, tris(2-hydroxyethyl)tallow ammonium acetate,

9. The method to electrodeposit according to claim 1 wherein $Y^-$ is selected from the group consisting of a halogenide anion, a carboxylate anion, an organic sulphate, an inorganic sulphate, sulphonate, carbonate, nitrate, nitrite, thiocyanate, hydroxide, and sulphonylimide anion.

10. The method to electrodeposit according to claim 3 wherein the ionic liquid of the formula $N^+R_5R_6R_7R_8\ Y^-$ has an iodine value of above 1 g $l_2$ per 100 g of ionic liquid.

11. The method to electrodeposit according to claim 3 wherein the molar ratio of the ammonium cation of the ionic liquid to the metal cation of the metal salt or derived from the metal anode is between 1,000:1 and 3:1.

12. The method to electrodeposit according to claim 4 wherein the molar ratio of the ammonium cation of the ionic liquid to the metal cation of the metal salt or derived from the metal anode is between 1,000:1 and 3:1.

13. The method to electrodeposit according to claim 10 wherein the molar ratio of the ammonium cation of the ionic liquid to the metal cation of the metal salt or derived from the metal anode is between 1,000:1 and 3:1.

14. The method to electrodeposit according to claim 3 wherein the metal is selected from the group consisting of chromium, aluminium, and copper.

15. The method to electrodeposit according to claim 5 wherein the metal is selected from the group consisting of chromium, aluminium, and copper.

16. The method to electrodeposit according to claim 13 wherein the metal is selected from the group consisting of chromium, aluminium, and copper.

17. The method to electrodeposit according to claim 3 wherein the ionic liquid is selected from the group consisting of octadecyl methyl bis(2-hydroxyethyl) ammonium chloride, cocobis(2-hydroxyethyl)methyl ammonium nitrate, cocobis(2-hydroxyethyl)methyl ammonium chloride, cocobis(2-hydroxyethyl)benzyl ammonium chloride, oleylbis(2-hydroxyethyl)methyl ammonium chloride, coco[polyoxyethylene(15)]methyl ammonium chloride, coco [polyoxyethylene(15)}methyl ammonium methylsulphate, coco[polyoxyethylene(17)]methyl ammonium chloride, octadecyl[polyoxyethylene(15)]methyl ammonium chloride, hydrogenated tallow[polyoxyethylene(15)]methyl ammonium chloride, tris(2-hydroxyethyl)tallow ammonium acetate.

18. The method to electrodeposit according to claim 5 wherein the ionic liquid is selected from the group consisting of octadecylmethylbis(2-hydroxyethyl) ammonium chloride, cocobis(2-hydroxyethyl)methyl ammonium nitrate, cocobis (2-hydroxyethyl)methyl ammonium chloride, cocobis(2-hydroxyethyl) benzyl ammonium chloride, oleylbis(2-hydroxyethyl)methyl ammoninm chloride, coco[polyoxyethylene (15)]methyl ammoniumchloride, coco[polyoxyethylene (15)]methyl ammonium methylsulphate, coco [polyoxyethylene(17)]methyl ammonium chloride, octadecyl[polyoxyethylene(15)]methyl ammonium chloride, hydrogenated tallow[polyoxyethylene(15)]methyl ammonium chloride, and tris(2-hydroxyethyl) tallow ammonium acetate.

19. The method to electrodeposit according to claim 7 wherein the ionic liquid is selected from the group consisting of octadecylmethylbis(2-hydroxyethyl) ammonium chloride, cocobis(2-hydroxyethyl)methyl ammonium nitrate, cocobis (2-hydroxyethyl)methyl ammonium chloride, cocobis(2-hydroxyethyl)benzyl ammonium chloride, oleylbis(2-hydroxyethyl)methyl ammonium chloride, coco[polyoxyethylene (15)]methyl ammonium chloride, coco[polyoxyethylene (15)]methyl ammonium methylsulphate, coco [polyoxyethylene(17)]methyl ammonium chloride, octadecyl[polyoxyethylene(15)]methyl ammonium chloride, hydrogenated tallow[polyoxyethylene(15)]methyl ammonium chloride,and tris(2-hydroxyethyl)tallow ammonium acetate.

20. The method to electrodeposit according to claim 16 wherein the ionic liquid is selected from the group consisting of octadecylmethylbis(2-hydroxyethyl) ammonium chloride, cocobis(2-hydroxyethyl)methyl ammonium nitrate, cocobis (2-hydroxyethyl)methyl ammonium chloride, cocobis(2-hydroxyethyl)benzyl ammonium chloride, oleylbis(2-hydroxyethyl)methyl ammonium chloride coco[polyoxyethylene (15)]methyl ammonium chloride, coco[polyoxyethylene (15)]methyl ammonium methylsulphate, coco [polyoxyethylene(17)]methyl ammonium chloride, octadecyl[polyoxyethylene(15)]methyl ammonium chloride, hydrogenated tallow[polyoxyethylene(15)]methyl ammonium chloride,and tris(2-hydroxyethyl)tallow ammonium acetate.

* * * * *